US008251930B2

(12) United States Patent
Ido

(10) Patent No.: US 8,251,930 B2
(45) Date of Patent: Aug. 28, 2012

(54) WALKING ASSISTANCE DEVICE

(75) Inventor: Tetsuya Ido, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 1126 days.

(21) Appl. No.: 11/912,790

(22) PCT Filed: Jun. 5, 2006

(86) PCT No.: PCT/JP2006/311202
§ 371 (c)(1),
(2), (4) Date: Oct. 26, 2007

(87) PCT Pub. No.: WO2007/007484
PCT Pub. Date: Jan. 18, 2007

(65) Prior Publication Data

US 2009/0036815 A1 Feb. 5, 2009

(30) Foreign Application Priority Data

Jul. 13, 2005 (JP) ..... 2005-203860

(51) Int. Cl.
*A61H 1/00* (2006.01)

(52) U.S. Cl. ..... 601/5; 601/23; 601/35

(58) Field of Classification Search ..... 601/1, 5, 601/23, 27, 32–35, 84; 600/587
See application file for complete search history.

(56) References Cited

U.S. PATENT DOCUMENTS

| | | | | |
|---|---|---|---|---|
| 4,697,808 | A * | 10/1987 | Larson et al. | 482/51 |
| 5,330,417 | A * | 7/1994 | Petersen et al. | 602/16 |
| 6,824,569 | B2 * | 11/2004 | Okediji | 623/30 |
| 7,650,204 | B2 * | 1/2010 | Dariush | 700/245 |
| 7,785,279 | B2 * | 8/2010 | Sankai | 601/5 |
| 8,177,733 | B2 * | 5/2012 | Ashihara et al. | 601/35 |
| 2004/0102723 | A1 * | 5/2004 | Horst | 601/5 |
| 2004/0158175 | A1 * | 8/2004 | Ikeuchi et al. | 601/5 |
| 2004/0249319 | A1 * | 12/2004 | Dariush | 601/5 |
| 2005/0059908 | A1 * | 3/2005 | Bogert | 601/5 |

FOREIGN PATENT DOCUMENTS

| | | | |
|---|---|---|---|
| GB | 2278041 | A * | 11/1994 |
| JP | 05-329186 | | 12/1993 |
| JP | 07-112035 | | 5/1995 |
| JP | 2003-220102 | | 8/2003 |

* cited by examiner

*Primary Examiner* — Justine Yu
*Assistant Examiner* — LaToya M. Louis
(74) *Attorney, Agent, or Firm* — Rankin, Hill & Clark LLP

(57) ABSTRACT

A walking assistance device (1) has a body-mounted assembly (2) installed on the waist of a user (A), foot-mounted assemblies (3L, 3R) installed on feet, and leg links (4L, 4R) which connect the foot-mounted assemblies (3L, 3R) to the body-mounted assembly (2). The foot-mounted assemblies (3L, 3R) are provided with floor reaction force sensors (13L, 13R). Results obtained by multiplying the absolute values of floor reaction force vectors (three-dimensional vectors) detected by the floor reaction force sensors (13L, 13R) by a predetermined ratio are defined as target values of the magnitudes of the supporting forces transmitted to the leg links (4L, 4R) from the foot-mounted assemblies (3L, 3R). Actuators (20L, 20R) of the leg links (4L, 4R) are controlled such that the supporting forces having the magnitudes of the target values act on the leg links (4L, 4R) from the foot-mounted assemblies (3L, 3R) through the intermediary of joints (19L, 19R).

15 Claims, 8 Drawing Sheets

WALKING ASSISTANCE DEVICE

TECHNICAL FIELD

The present invention relates to a walking assistance device adapted to assist a user (human being) with his/her walking.

BACKGROUND ART

Hitherto, as this type of walking assistance device, there has been known, for example, the one disclosed in paragraphs 0034 to 0036 and FIG. 15 and FIG. 16 of Japanese Unexamined Patent Application Publication No. H5-329186 (hereinafter referred to as Patent Document 1). According to the walking assistance device (device for assisting walking) described in Patent Document 1, supporting members are attached to the thigh, crus, and foot of each leg of the user. And, the joints that connect these supporting members are driven by actuators to impart a target propulsion power to the user. In this walking assistance device, when the user walks, a torque produced between each of the joints of the legs (hip joints, knee joints, and ankle joints) of the user and the actuator of the walking assistance device that is associated therewith is detected. Then, from the torque detection value, the force between the walking assistance device and the user is computed and the obtained result is compared with a set value that has been set in advance. Further, based on the comparison result, the drive power for the actuator is determined to control the actuator.

DISCLOSURE OF INVENTION

The walking assistance device described in the aforesaid Patent Document 1 is capable of generating a target propulsion power in a direction in which the user is moving (a force for assisting a motion of a free leg of the user), thereby to reduce the propulsion power required to be generated by the user himself/herself. However, as is obvious from FIG. 15 in Patent Document 1, the weight of the user has to be supported by the user himself/herself. This has led to unsatisfactorily reduced load on the user.

In addition, the one in Patent Document 1 does not have a technology for setting a target value of an acting force between the walking assistance device and the user according to a motion state of each leg of the user. This has been making it difficult to cause an assisting force suited to a motion state of each leg of the user to act on each leg of the user. For example, a floor reaction force required for each leg changes at each time while the user is in a walking motion, so that the assisting force to be borne by each leg portion of the walking assistance device is desirably changed accordingly. However, in the one disclosed in Patent Document 1, it is difficult to generate such an assisting force at each leg portion of the walking assistance device.

Moreover, the one disclosed in Patent Document 1 is adapted to control the drive of each of the hip joints, knee joints, and ankle joints of the walking assistance device. This requires complicated dynamic calculation or the like to generate appropriate driving forces for the joints. Further, in this case, the influences of modeling errors of dynamic models or calculation errors or the like frequently lead to inappropriate target values of driving forces for joints with respect to motions of the legs of the user. Hence, there has been a danger that a load on the user rather increases, depending on motion states of the legs of the user.

The present invention has been made with a view of the aforesaid background, and it is an object thereof to provide a walking assistance device that makes it possible to properly reduce a load on a user regardless of a motion state of each leg of the user.

To fulfill the aforesaid object, a walking assistance device according to the present invention is a walking assistance device provided with: a body-mounted assembly to be attached to a waist or torso or a thigh of a user; a pair of foot-mounted assemblies which are to be respectively attached to the feet of legs of the user; a pair of leg links which respectively connect the foot-mounted assemblies and the body-mounted assembly, a first joint constituting a portion that connects each leg link and the body-mounted assembly, a second joint provided at the middle of each leg link, a third joint constituting a portion that connects each leg link and each foot-mounted assembly, and a pair of actuators that drives the second joints of the leg links, each of the foot-mounted assemblies being equipped with a ground contact portion that comes in contact with the ground such that a floor reaction force for supporting the user and the walking assistance device on a floor surface acts in a state in which a leg of the user becomes a standing leg, and the walking assistance device further comprising a floor reaction force detecting means which detects a floor reaction force acting on the ground contact portion of each foot-mounted assembly as a three-dimensional floor reaction force vector, and an actuator control means which takes a value obtained by multiplying the absolute value of the detected floor reaction force vector of each foot-mounted assembly by a preset ratio as a target value having a magnitude of a supporting force to be transmitted to each leg link in the floor reaction force vector, and controls each of the actuators such that a supporting force having the magnitude of the target value is transmitted to the leg link from the foot-mounted assembly (a first invention).

According to the first invention described above, an actual floor reaction force acting on the ground contact portion of each foot-mounted assembly (an actual floor reaction force for supporting both the user and the walking assistance device on a floor surface) is detected as a three-dimensional floor reaction force vector. Further, a value obtained by multiplying the absolute value (magnitude) of the detected floor reaction force vector by the aforesaid rate (e.g., 30% or 40%) is defined as a target value having the magnitude of the supporting force. Therefore, the target value will be based on the absolute value of an actual floor reaction force vector acting on each foot-mounted assembly as a result of an actual motion of a leg of the user. Further, according to the first invention, each of the actuators is controlled such that a supporting force having the magnitude of the target value is transmitted to each leg link from the foot-mounted assembly. This arrangement allows each leg link to bear a supporting force having the magnitude for a desired ratio (a supporting force of the magnitude of the target value) in the absolute value of the actual floor reaction force vector acting on each foot-mounted assembly. At this time, of the absolute value of the actual floor reaction force vector acting on each foot-mounted assembly, the supporting force having the magnitude obtained by subtracting the load borne by each leg link will be borne by each leg of the user. In this case, a force obtained by subtracting the force for supporting the weight of each leg link and an inertial force caused by a motion of the leg link from the supporting force borne by the leg link acts as a force on the user in a lifting direction through the intermediary of the body-mounted assembly. The acting force makes it possible to reduce the force with which the user supports by his/her own legs.

Thus, according to the first invention, an actual floor reaction force vector that acts on each foot-mounted assembly as a result of a motion of each leg of the user is directly detected.

Further, the supporting force having the magnitude based on the absolute value (magnitude) of the detected floor reaction force vector is borne by each leg link. This makes it possible to properly reduce a load on the user regardless of a motion state of each leg of the user.

In the first invention described above, the second joint of each leg link is preferably a joint that permits bending and stretching of each leg link although it could be constituted of a translatory joint. In this case, each of the actuators will be an actuator that drives the second joint by imparting a torque to the second joint. Further, in this case, more specifically, preferably, the actuator control means determines a torque command value of each actuator required to transmit a supporting force having the magnitude of the target value to each leg link from a foot-mounted assembly by using a correlation among the supporting force, a generated torque of the second joint, and a bending angle of the leg link at the second joint, which is determined by regarding that the supporting force is a translational force vector having, as a line of action, a straight line that connects the first joint and the third joint of each leg link, and controls the actuator on the basis of the determined torque command value (a second invention).

In other words, according to the present invention, the supporting force is transmitted to a leg link from a foot-mounted assembly through the intermediary of a third joint. At this time, it can be assumed that, at the location of the third joint, the supporting force acting on a leg link becomes a translational force vector that uses the straight line connecting the first joint and the third joint of each leg link as the line of action. Further, the torque to be generated at a second joint is a torque that balances out the moment generated at the second joint by the translational force vector (the supporting force), and the relationship between the torque or the moment and the translational force vector (the supporting force) is determined by the bending angle of the leg link at the second joint (more specifically, determined on the basis of the geometric positional relationship among the first joint, the second joint, and the third joint of each leg link, which is associated with the bending angle). In other words, there is a certain correlation among the supporting force (the translational force vector), the generated torque at the second joint, and the bending angle of the leg link at the second joint. Hence, using the correlation makes it possible to determine a torque command value of each actuator required to transmit the supporting force having the magnitude of the target value to each leg link from a foot-mounted assembly by relatively simple arithmetic processing. Thus, the second invention allows each actuator to be properly controlled while determining a torque command value of each actuator without the need for complicated arithmetic processing.

In the first invention or the second invention described above, it is not always necessary to calculate a target value itself of the supporting force as long as each actuator is controlled such that an actual supporting force eventually takes the target value.

More specifically, the aforesaid second invention further includes, for example, a supporting force detecting means which detects the supporting force actually transmitted to each leg link from the foot-mounted assembly, and a bending angle detecting means which detects the bending angle of each leg link, wherein the actuator control means is constituted of a means which calculates the target value for each leg link by multiplying the absolute value of the detected floor reaction force vector by the ratio, a means which determines a required supporting force for each leg link by a feedback control law such that the magnitude of the detected supporting force is brought close to the calculated target value, a means which determines a torque command value of each actuator on the basis of the determined required supporting force, the detected bending angle of each leg link, and the correlation, and a means which controls each actuator on the basis of the determined torque command value (a third invention).

With this arrangement, an actual supporting force detected by the supporting force detecting means is used directly as a control variable, and a generated torque of each actuator (by extension, a generated torque at a second joint) is controlled by feedback control such that the magnitude of the supporting force approximates to the target value. This makes it possible to smoothly control each actuator such that the magnitude of an actual supporting force takes the target value.

In the third invention, preferably, the supporting force detecting means includes a three-axis force sensor interposed between the third joint and the foot-mounted assembly or between the third joint and the leg link, and detects the supporting force on the basis of an output of the three-axis force sensor (a fourth invention).

In this case, regardless of whether the three-axis force sensor is interposed between the third joint and the foot-mounted assembly or between the third joint and the leg link, the magnitude of a translational force acting on the three-axis force sensor will be actually substantially equal to the magnitude of a supporting force (the magnitude of the translational force vector). Further, the supporting force (the translational force vector) is a vector in the direction of the straight line connecting the first joint and the third joint of each leg link, as described above, so that the supporting force actually transmitted to each leg link can be detected on the basis of an output of the three-axis force sensor (an output indicating force component values in the directions of three axes).

Further, in the third invention or the fourth invention, preferably, the actuator control means includes a means which sets the target value associated with the leg link of a free leg of the user to zero (a fifth invention).

According to the fifth invention, each actuator is controlled such that the supporting force transmitted to the leg link of a free leg of the user approximates to zero and, in turn, a generated torque at the second joint of the leg link approximates to zero. Hence, friction of the actuator or the second joint can be borne by the walking assistance device in a state wherein the user is lifting the leg in the air. As a result, a load while a free leg of the user is in motion can be reduced.

In the aforesaid second invention, another further specific mode may include a torque detecting means which detects a torque actually generated at the second joint of each leg link, and a bending angle detecting means which detects the bending angle of each leg link, wherein the actuator control means may be constituted of a means which determines a target torque of the second joint of the leg link to transmit a supporting force having the magnitude of the target value to each leg link on the basis of the absolute value of the detected floor reaction force vector, the ratio, the detected bending angle of each leg link, and the correlation, a means which determines the torque command value of each actuator by a feedback control law such that the detected torque of the second joint is brought close to the determined target torque, and a means which controls each actuator on the basis of the determined torque command value (a sixth invention).

According to the sixth invention, an actual torque of the second joint detected by the torque detecting means is used as a control variable, and a generated torque of each actuator (by extension, a generated torque at a second joint) is controlled by feedback control such that the torque approximates to a target torque for transmitting the supporting force having the magnitude of the target value to each leg link. This makes it possible to smoothly control each actuator such that the magnitude of an actual supporting force indirectly takes the target value. In this case, more specifically, the means which determines a target torque calculates, for example, the target value obtained by multiplying the absolute value of the floor reaction force vector by the ratio, then determines the target torque on the basis of the target value, the detected bending angle of each leg link, and the correlation (converts the calculated target value of a supporting force into the target torque). Alternatively, the torque of the second joint associated with the absolute value of the floor reaction force vector is calculated on the basis of the absolute value of the floor reaction force vector, the detected bending angle of each leg link, and the correlation, then the calculated torque (this torque corresponds to the torque of the second joint in a case where it is assumed that the magnitude of a supporting force is equal to the absolute value of a floor reaction force vector) is multiplied by the ratio so as to determine the target torque.

In the seventh invention, preferably, the actuator control means includes a means which sets the target torque associated with the leg link of a free leg of the user to zero (a seventh invention).

According to the seventh invention, each actuator is controlled such that the generated torque of the second joint of the leg link of a free leg of the user approximates to zero (such that, consequently, the supporting force transmitted to the leg link approximates to zero). Hence, as with the fifth invention, friction of the actuator or the second joint can be borne by the walking assistance device in a state wherein the user is lifting the leg in the air. As a result, a load while a free leg of the user is in motion can be reduced.

In the first to the seventh inventions explained above, preferably, the floor reaction force detecting means includes a three-axis force sensor provided in each foot-mounted assembly at the location right below the metatarsophalangeal joint of a foot of the user, and detects the floor reaction force vector on the basis of an output of the three-axis force sensor (an eighth invention).

According to the eighth invention, especially when the user climbs stairs by landing at the tiptoes of his/her foot or when the user kicks the ground at the tiptoes of his/her foot at the rear side to leave the foot off the ground when walking on a level ground, the absolute value of a floor reaction force vector acting on each foot-mounted assembly can be accurately detected from an output of the three-axis force sensor. Hence, the floor reaction force vectors at the tiptoes, which are important for accomplishing smooth motions of the user when climbing stairs or walking on a level ground, can be properly borne by the leg links of the walking assistance device. As a result, motions of the user can be effectively assisted. In addition, the three-axis force sensors of the floor reaction force detecting means are mounted on the tiptoe side, making it possible to prevent a shock, which is produced when the user lands at the heel of a foot while walking, from being directly transmitted to the three-axis force sensor. This makes it possible to reduce the shock reflected on the control of each actuator of the walking assistance device.

In the first to the eighth inventions described above, preferably, each foot-mounted assembly includes an annular rigid member into which the toe portion of the foot of each leg of the user is inserted, the rigid member is connected to the leg link through the intermediary of the third joint, and the rigid member has the ground contact portion provided on the bottom surface thereof (a ninth invention).

With this arrangement, when each foot-mounted assembly comes in contact with the ground, the supporting force to be borne by each leg link (a part of a floor reaction force vector acting on the foot-mounted assembly) can be securely transmitted to each leg link from the foot-mounted assembly.

BEST MODE FOR CARRYING OUT THE INVENTION

The following will explain a first embodiment of the present invention with reference to FIG. 1 to FIG. 4. First, referring to FIG. 1 and FIG. 2, the structure of a walking assistance device according to the present embodiment will be explained. FIG. 1 is a diagram showing the walking assistance device according to the present embodiment and a user wearing the device viewed from the front (a diagram observed in a frontal plane), and FIG. 2 is a diagram showing the walking assistance device and the user viewed sideways (a diagram observed in a sagittal plane).

Referring to FIG. 1 and FIG. 2, a walking assistance device 1 according to the present embodiment is provided with a body-mounted assembly 2 to be attached to the waist of a user A, a pair of left and right foot-mounted assemblies 3L, 3R to be attached to the left and right feet of the user A, and a pair of left and right leg links 4L, 4R, which connect the foot wear assemblies 3L and 3R, respectively, to the body wear assembly 2. The foot-mounted assemblies 3L and 3R are laterally symmetrical, sharing the same structure. The same applies to the leg links 4L and 4R. FIG. 1 and FIG. 2 show a state wherein the user A is standing in a substantially upright posture with both legs positioned laterally side by side. In this state, the leg link 4L and the leg link 4R are arranged in the same posture in the lateral direction of the user A, so that the leg links 4L, 4R overlap in the drawing in FIG. 2 (the right leg link 4R is positioned on the near side in FIG. 2). The same applies to the foot-mounted assemblies 3R and 3L in FIG. 2.

Here, in the explanation of the embodiment in the present description, a symbol "R" will be used to mean association with the right leg of the user A or the right leg link of the walking assistance device 1, while a symbol "L" will be used to mean association with the left leg of the user A or the left leg link of the walking assistance device 1. However, if there is no particular need to distinguish between right and left, then the symbols R and L will be frequently omitted.

The body-mounted assembly 2 in the present embodiment is constructed by connecting a plurality of harness members 5 composed of a flexible material, such as cloth, with each other. The body-mounted assembly 2 is attached to the waist such that the harness members 5 wrap the waist of the user A. In this case, the body-mounted assembly 2 is equipped with, as the major harness members 5, a harness member 5*a* fixed onto the waist by being wound around the outer periphery of the waist and harness members 5*b* provided such that they extend between the front side and the back side of the waist via the roots of both legs (crotch). Further, these harness members 5*a* and 5*b* are connected to each other by auxiliary harness members 5. This enables the body-mounted assembly 2 attached to the user A to impart an assisting force in a lifting direction (upward) to the waist of the user A through the intermediary of the harness members 5*a* and 5*b* by an operation of the walking assistance device 1, which will be described later.

Further, a chassis 6*a*L of a controller 6L responsible for motion control of the left leg link 4L (for controlling an electric motor 20L, which will be discussed later) is secured on the left surface of the harness member 5*a*. Similarly, a chassis 6*a*R of a controller 6R responsible for motion control of the right leg link 4R (for controlling an electric motor 20R, which will be discussed later) is secured on the right surface of the harness member 5*a*.

The connecting way of the harness members 5 shown in FIG. 1 and FIG. 2 is just one example, and it is not restricted thereto. In the present embodiment, the body-mounted assembly 2 has been attached to the waist of the user A; alternatively, however, it may be attached to a torso above the waist or to a thigh. Further alternatively, the body-mounted assembly 2 may be attached to two or more portions among the waist, the torso, and thighs. The body-mounted assembly 2 may be attached to the waist or the torso or a thigh such that it allows a vertical force to act between itself and the waist or the torso or a thigh of the user A.

The foot-mounted assemblies 3L, 3R are adapted to be attached to the foot of the left leg and the foot of the right leg, respectively, of the user A. Each of the foot-mounted assemblies 3 is provided with a shoe 7 to be put on each foot of the user A, a stirrup-like annular rigid member (annular highly rigid member) 8 into which the toe portion of the shoe 7 is removably inserted, a plate-like rigid plate (plate-like highly rigid member) 9 secured to the bottom surface of the bottom portion of the annular rigid member 8 in a posture substantially parallel to the sole of the shoe 7, and a plate-like elastic member 10 provided in a posture substantially parallel to the rigid plate 9, opposing the bottom surface of the rigid plate 9. The plate-like elastic member 10 disposed on the bottom surface of each foot-mounted assembly 3 functions as a ground contact portion. Hereinafter, the plate-like elastic member 10 will be referred to as the elastic ground contact portion 10.

The shoe 7 is secured to the annular rigid member 8 through the intermediary of a belt 11 (refer to FIG. 2) so that the shoe 7 does not slip out of the annular rigid member 8.

A hard elastic member 12 and a floor reaction force sensor 13 are interposed between the rigid plate 9 and the elastic ground contact member 10. The floor reaction force sensor 13 is composed of a three-axis force sensor which detects translational forces in the directions of three axes. The floor reaction force sensor 13 is disposed such that it is positioned at a location substantially right below the metatarsophalangeal joint of a foot (the joint of the root of the thumb of the foot; the joint will be hereinafter referred to as the MP joint) of the user A with the shoe 7 on. The hard elastic member 12 is disposed such that it is positioned at a location adjacent to the heel of the foot of the user A with the shoe 7 on. Further, these floor reaction force sensor 13 and hard elastic member 12 are secured to the rigid plate 9 and the elastic ground contact portion 10, respectively. Thus, the elastic ground contact portion 10 is fixed to the bottom surface of the rigid plate 9 through the intermediary of the hard elastic member 12 and the floor reaction force sensor 13. The elastic ground contact portion 10 is adapted to protect the floor reaction force sensor 13 by preventing an excess impact force from being applied to the floor reaction force sensor 13 at the time of landing or the like of the foot-mounted assembly 3. The rigid plate 9 is adapted to cause substantially all floor reaction force to act on the floor reaction force sensor 13 regardless of a distribution state of the floor reaction force acting on the elastic ground contact portion 10 from a floor surface (whether the user A rests his/her own weight toward the heel of a foot or rests his/her own weight toward the toes) in a state wherein substantially the entire bottom surface of the foot-mounted assembly 3 (the bottom surface of the elastic ground contact portion 10) is in contact with the ground.

Further, in the present embodiment, a supporting force sensor 14 is secured to the top surface of the annular rigid member 8. As with the floor reaction force sensor 13, the supporting force sensor 14 is composed of a three-axis force sensor.

In the present embodiment, one-axis component of a translational force vector detected by the floor reaction force sensor 13 and the supporting force sensor 14 provided in each foot-mounted assembly 3 is a component in the direction of one axis, which is substantially perpendicular to a floor surface in a state wherein substantially entire surface of the sole of each foot-mounted assembly 3 is in contact with the floor surface, and the remaining two-axis components are components in the directions of two axes, which are orthogonal to each other on a plane perpendicular to the direction of the one axis (on a plane parallel to the floor surface). Further, the floor reaction force sensor 13 and the supporting force sensor 14 provided in the left foot-mounted assembly 3L output their detection signals to the controller 6L through signal lines, which are not shown. Similarly, the floor reaction force sensor 13 and the supporting force sensor 14 provided in the right foot-mounted assembly 3R output their detection signals to the controller 6R through signal lines, which are not shown.

Supplementally, the floor reaction force sensor 13 constitutes, in combination with a floor reaction force measurement processor, which will be discussed later, a floor reaction force detecting means in the present invention. The supporting force sensor 14 constitutes, in combination with a supporting force measurement processor, which will be discussed later, a supporting force detecting means in the present invention.

The leg links 4L, 4R are disposed nearly along the left leg and the right leg, respectively, of the user A. Each of the leg links 4 is provided with a rod-like thigh frame 15 corresponding to the thigh of a leg of the user A, a rod-like crus frame 16 corresponding to the crus of the leg, a first joint 17 which connects the upper end of the thigh frame 15 to the body-mounted assembly 2, a second joint 18 which connects the lower end of the thigh frame 15 to the upper end of the crus frame 16, and a third joint 19 which connects the lower end of the crus frame 16 to the foot-mounted assembly 2. In other words, each leg link 4 is provided with the first joint 17, the second joint 18, and the third joint 19, at the upper end portion (the portion connected to the body-mounted assembly 2), the intermediate portion, and the lower end portion (the portion connected to the foot-mounted assembly 3), respectively, the first joint 17 and the second joint 18 being connected by the thigh frame 15 and the second joint 18 and the third joint 19 being connected by the crus frame 16.

The first joint 17L of the left leg link 4L connects the upper end of the thigh frame 15L to the chassis 6*a*L of the controller 6L. Similarly, the first joint 17R of the right leg link 4R connects the upper end of the thigh frame 15R to the chassis 6*a*R of the controller 6R. Thus, in the present embodiment, the leg links 4 have the upper ends thereof (the upper ends of the thigh frames 15) connected to the right and left sides of the harness 5*a* of the body-mounted assembly 2 through the intermediary of the first joints 17 and the chassis 6*a*. Alternatively, the chassis 6*a* of each controller 6 may be attached to a different place from the side portions of the body-mounted assembly 2 (e.g., the chassis 6*a* may be fixed to the back of the harness 5*a* of the body-mounted assembly 2 or the chassis 6*a* of the controllers 6 may be accommodated in a case that the user A carries on his/her back), and the portions of the first joints 17 to be attached to the body-mounted assembly 2 may be directly mounted on the sides of the harness 5*a*.

The first joints 17 in the present embodiment are joints that have a degree of freedom of rotation about one axis (about axis a in FIG. 1) in the lateral direction of the user A. This permits rocking motions (swinging motions) of the leg links 4 in the longitudinal direction, the first joints 17 being the points of support. Supplementally, the harness member 5*a* to which the chassis 6*a* of the controllers 6 have been fixed is flexible, thus permitting rocking motions of the leg links 4 also in the lateral direction (motions equivalent to abduction-adduction motions of the legs of the user A) by flexure or torsion of the harness member 5*a* or other harness members 5. Incidentally, the first joints 17 may be formed of free joints having a degree of freedom of rotation about three axes, such as ball joints. Alternatively, the first joints 17 may be joints having a degree of freedom of rotation about two axes in the lateral direction and the longitudinal direction.

Each of the second joints 18 is a joint having a degree of freedom of rotation about one axis (about axis b in FIG. 1) in the lateral direction of the user A. This allows the crus link 16 of each leg link 4 to relatively rotate about the axis b of the second joint 18 with respect to the thigh link 15. This in turn permits bending and stretching motions of each leg link 4 at the second joint 18.

In the present embodiment, each of the second joints 18 is provided with an electric motor 20 serving as an actuator that drives the second joint 18 and a rotary encoder 21 which detects a rotational angle of the second joint 18. The rotary encoder 21 in combination with the bending angle measurement processor, which will be described later, constitutes a bending angle detecting means in the present invention. The rotary encoder 21 outputs a detection signal based on a rotational angle from a predetermined reference rotational position of the second joint 18 (e.g., the rotational position of the second joint 18 in a state wherein the user A is standing in an upright posture) as a signal that indicates a bending angle of the leg link 4 at the second joint 18. The rotary encoders 21L, 21R output the detection signals of rotational angles to the controllers 6L, 6R, respectively, through signal lines not shown. The electric motors 20L, 20R are connected to the controllers 6L, 6R, respectively, through connection lines, not shown, for supplying current from the controllers 6L, 6R.

Supplementally, the actuators which drive the second joints 18 may use hydraulic or pneumatic actuators or polymer actuators (muscle type actuators). The actuators may be installed on the body-mounted assembly 2 or the torso of the user A to drive the second joints 18 through wires or the like. The bending angle detecting means may be composed of a potentiometer or the like in place of the rotary encoder 21. These supplemental matters apply to other embodiments, which will be described hereinafter.

Each of the third joints 19 is composed of a free joint having a degree of freedom of rotation about three axes and it connects the lower end of the crus frame 16 to the supporting force sensor 14 provided in the foot-mounted assembly 3. Thus, the crus frame 16 of each leg link 4 is connected to the annular rigid member 8 of the foot-mounted assembly 3 through the intermediary of the third joint 19 and the supporting force sensor 14, the supporting force sensor 14 being interposed between the third joint 19 and the annular rigid member 8.

The length of the thigh frame 15 of each leg link 4 (the interval between the first joint 17 and the second joint 18) and the length of the crus frame 16 (the interval between the second joint 18 and the third joint 19) are set such that the leg link 4 bends at the second joint 18, as shown in FIG. 2, in a state wherein the user A having an average figure stands in an upright posture. In other words, they are set such that the leg links 4 do not fully stretch regardless of a posture of the user A. This is to avoid a singularity state wherein the thigh frame 15 and the crus frame 16 are aligned on a straight line. With this arrangement, independently of a posture of the user A, an upward assisting force can be applied to the user A from the walking assistance device 1 by operating the electric motor 20.

The above has described the mechanical construction of the walking assistance device 1 according to the present embodiment. According to the walking assistance device 1 having such a construction, if, for example, both legs of the user A are standing legs (legs to support the weight of the user A on a floor surface) (the state of a "double-stance period"), then both foot-mounted assembles 3, 3 come in contact with the ground through the intermediary of the elastic ground contact portions 10, 10, and a floor reaction force (three-dimensional vector) acts on each of the foot-mounted assemblies 3 through the intermediary of each of the elastic ground contact portions 10. At this time, the floor reaction force acts on the floor reaction force sensor 13 provided in the foot-mounted assembly 3 and it is detected by the floor reaction force sensor 13 as a three-dimensional translational force vector. If only one leg of the user A is a standing leg (the state of a so-called "single-stance period"), then only the foot-mounted assembly 3 (3L or 3R) of the standing leg comes in contact with the ground, and a floor reaction force (translational force vector) acting thereon is detected by the floor reaction force sensor 13 provided in the foot-mounted assembly 3. The floor reaction force acting on the foot-mounted assembly 3 associated with the non-standing leg (the free leg) will be zero. In this case, strictly speaking, the floor reaction force sensor 13 is subjected to an inertial force of the elastic ground contact portion 10 and a gravitational force; however, the weight of the elastic ground contact portion 10 is sufficiently small. Therefore, the translational force acting on the floor reaction force sensor 13 of the free leg will be substantially zero.

Here, in the state of either the double-stance period or the single-stance period, the resultant force (hereinafter referred to as the total floor reaction force) of the floor reaction force vectors of both foot-mounted assemblies 3, 3 is a supporting force for supporting the total weight of the user A and the walking assistance device 1 (the sum of the weight of the user A and the weight of the walking assistance device 1) and the inertial force generated by the motions thereof on a floor (a force that balances out the resultant force of the gravitational force entirely acting on the user A and the walking assistance device 1 and the inertial force thereof). At this time, in a state wherein the generated torque of the two electric motors 20, 20 is zero (in a state wherein the supply of current to the two electric motors 20, 20 is cut off), most of the aforesaid total floor reaction force (more specifically, force obtained by removing the weight equivalent of a part of the foot-mounted assembly 3, including the rigid plate 9 and the annular rigid member 8, of each foot-mounted assembly 3 associated with a standing leg of the user A from the total floor reaction force) is borne by the standing leg (both legs or one leg) of the user A.

Meanwhile, if the electric motor 20 provided in each leg link 4 associated with the standing leg of the user A imparts a torque in the direction in which the leg link 4 stretches to the second joint 18, then a part of the floor reaction force vector acting on the foot-mounted assembly 3 of the leg link 4 is transmitted to the leg link 4 through the intermediary of the annular rigid member 8 of the foot-mounted assembly 3 and the third joint 19. The force transmitted (the translational force vector acting on the leg link 4 through the intermediary of the third joint 19 from the foot-mounted assembly 3) corresponds to a supporting force in the present invention. The supporting force means a portion borne by the leg link 4 in the floor reaction force vector acting on the foot-mounted assembly 3 associated with the standing leg of the user A. Hereinafter, the supporting force will be referred to as the assisting force. The assisting force transmitted to the leg link 4 of a standing leg as described above is detected as a three-dimensional translational force vector by the supporting force sensor 14.

Supplementally, a translational force vector acting on the supporting force sensor 14 (a translational force vector detected by the supporting force sensor 14) and a translational force vector acting on the leg link 4 from the third joint 19 generally have different directions. The supporting force sensor 14, however, is provided in the vicinity of the third joint 19, so that the absolute value of the translational force vector acting on the supporting force sensor 14 and the absolute value of the translational force vector acting on the leg link 4 from the third joint 19 are substantially the same. Further, in the walking assistance device 1 according to the present embodiment, only the body-mounted assembly 2 and the foot-mounted assemblies 3, 3 are restrained by the user A; therefore, the assisting force of each leg link 4 (the translational force vector acting on the leg link 4 through the intermediary of the third joint 19 from the foot-mounted assembly 3) will be a vector having the straight line, which connects the third joint 19 and the first joint 17 of the leg link 4, as the line of action. Thus, an assisting force can be detected from an output of the supporting force sensor 14.

In the present embodiment, the supporting force sensor 14 has been interposed between the third joint 19 and the annular rigid member 8 of the foot-mounted assembly 3; it may be, however, interposed between the third joint 19 and the crus frame 16 of the leg link 4 in the vicinity of the third joint 19. In this case, a translational force vector acting on the supporting force sensor 14 and a translational force vector acting on the leg link 4 from the third joint 19 substantially agree with each other in their directions and absolute values.

A part of the assisting force transmitted from the foot-mounted assembly 3 to the leg link 4 as described above (more specifically, the force obtained by subtracting the force for supporting the weight and the inertial force of the leg link 4 on a floor from the assisting force) acts on the body-mounted assembly 2 through the intermediary of the first joint 17 of the leg link 4. This makes it possible to apply an upward (lifting direction) assisting force to the user A from the leg link 4 through the intermediary of the body-mounted assembly 2. Thus, the portion of the total floor reaction force borne by each leg of the user A can be reduced. In the present embodiment, the generated torque of each electric motor 20 is controlled such that the assisting force detected by the supporting force sensor 14 as described above takes a predetermined target value, thereby causing an assisting force in the lifting direction to act on the user A from each leg link 4 through the intermediary of the body-mounted assembly 2.

The controllers 6 will now be explained in detail with reference to FIG. 3 and FIG. 4. FIG. 3 is a block diagram showing the functional construction of the controllers 6, and FIG. 4 is a diagram for explaining the control processing by the controllers 6. In the present embodiment, the controllers 6L and 6R share the same construction, so that components relevant to the controller 6R are indicated by parentheses in FIG. 3. FIG. 4 typically shows the leg link 4 and the foot-mounted assembly 3.

As shown in FIG. 3, each controller 6 includes an arithmetic processor 30 composed mainly of a CPU, a RAM, a ROM, an input/output interface circuit, and a driver circuit 31 of the electric motor 20. The arithmetic processor 30 corresponds to an actuator control means in the present invention. The arithmetic processor 30 is provided with, as its functional means, a floor reaction force measurement processor 41, a target assisting force determiner 42, an assisting force measurement processor 43, a PID control unit 44, a bending angle measurement processor 45, and a torque converter 46. Both or one of the controllers 6L and 6R is equipped with a power supply circuit which includes a capacitor, such as a battery, and a power switch, which are not shown, and electric power is supplied from the power supply circuit to circuits of each controller 6 and each electric motor 20.

Supplementally, in the present embodiment, each electric motor 20 is provided with the controller 6; alternatively, however, the operations of both electric motors 20L, 20R may be controlled by a single controller. In this case, the controller may be provided with a single arithmetic processor to control the electric motors 20 in parallel by time sharing processing of the arithmetic processor. Further, the capacitor or the power supply circuit may be attached to the body-mounted assembly 2 or the torso of the user A, separately from the controllers. These supplemental matters will similarly apply to other embodiments, which will be described hereinafter.

The detailed processing of each section of the arithmetic processor 30 will now be explained, and the control processing by the controllers 6 will be also explained. In the following explanation, the control processing by the controller 6L will be representatively explained, but the same will apply to the controller 6R. Further, in the following explanation, the directions of the three axes of translational force vectors detected by the supporting force sensor 14 and the floor reaction force sensor 13, respectively, will be denoted by the x-axis, the y-axis, and the z-axis in FIG. 4, and force components in the directions of the axes will be accompanied by suffixes x, y, and z, respectively. In this case, the z-axis is an axis which is substantially perpendicular to a floor surface in a state wherein substantially entire bottom surface of the foot-mounted assembly 3 is in contact with the ground, and the x-axis and the y-axis are orthogonal axes on a plane that is perpendicular to the z-axis. Further, regarding force components in the z-axis direction, in particular, the direction of the arrow of the z-axis in FIG. 4 is defined as the forward direction.

The controller 6L carries out the processing by the arithmetic processor 30L, which will be explained below, at a predetermined control processing cycle. First, outputs of the rotary encoder 21L, the supporting force sensor 14L, and the floor reaction force sensor 13L are captured into a bending angle measurement processor 45L, an assisting force measurement processor 43L, and a floor reaction force measurement processor 41L, respectively, and the processing by these processors 45L, 43L, and 41L is carried out.

The bending angle measurement processor 45L measures the rotational angle of the second joint 18L from a predetermined reference rotational position on the basis of the output of the rotary encoder 21L. Then, the bending angle measurement processor 45L adds the measured rotational angle to the bending angle of the leg link 4L at the reference rotational position (this being stored and retained beforehand in a memory, not shown) to determine a bending angle θ1_L of the leg link 4L at the second joint 18L. The bending angle θ1_L is the angle formed by the thigh link 15L and the crus link 16L (more precisely, the angle formed by a segment connecting the first joint 17L and the second joint 18L and a segment connecting the second joint 18L and the third joint 19L), as shown in FIG. 4.

Based on the output of the supporting force sensor 14L (the detection values of the translational forces in the three-axis directions), the assisting force measurement processor 43L determines an assisting force Fa_L as the detection value of the translational force acting on the leg link 4L from the third joint 19L (the supporting force transmitted from the foot-mounted assembly 3L to the leg link 4L). Specifically, the assisting force Fa_L is determined as shown below.

First, the absolute value of the translational force vector acting on the supporting force sensor 14L ($=\sqrt{(Fax^2+Fay^2+Faz^2)}$) is determined from the detection values of the force components in the three-axis directions (Fax, Fay, and Faz) (more specifically, the values obtained by removing high-frequency components and a predetermined offset from the detection values of the force components in the three-axis directions) indicated by the output of the supporting force sensor 14L. Then, the absolute value is multiplied by the sign of the detection value of the force component in the z-axis direction Faz so as to determine the assisting force Fa_L (the translational force actually acting on the leg link 4L from the foot-mounted assembly 3L through the intermediary of the third joint 19L). In other words, the assisting force Fa_L is calculated according to expression (1) given below.

$$Fa_L=sgn(Faz)\cdot\sqrt{(Fax^2+Fay^2+Faz^2)} \quad (1)$$

where sgn( ) denotes a signum function. The magnitude of the assisting force Fa_L determined as described above is equal to the absolute value of the translational force vector detected by the supporting force sensor 14L and has the same sign as that of Faz. In this case, regarding the sign of the assisting force Fa_L, if the left leg of the user A is a standing leg (when the foot-mounted assembly 3L is in contact with the ground), then Fa_L>0 always holds. When the left leg of the user A is a free leg, and if the user A tries to bend the left leg, then Fa_L<0 holds, or if the user A tries to stretch the left leg, then Fa_L>0 holds.

Supplementally, the translational force vector actually acting on the leg link 4L from the foot-mounted assembly 3L through the intermediary of the third joint 19L will be the vector whose line of action is the straight line connecting the third joint 19L and the first joint 17L, as described above. The assisting force Fa_L determined as described above indicates the magnitude and the direction of the translational force vector that actually acts on the leg link 4L from the third joint 19L on the aforesaid line of action, as shown in FIG. 4. In the example shown in FIG. 4, Fa_L>0 holds.

In the floor reaction force measurement processor 41L, Ft_L as the detection value of the floor reaction force acting on the foot-mounted assembly 3L is determined on the basis of the output of the floor reaction force sensor 13L (the detection values of the translational forces in the three-axis directions). More specifically, the floor reaction force Ft_L is determined as described below.

First, the absolute value of the translational force vector acting on the floor reaction force sensor 13L ($=\sqrt{(Ftx^2+Fty^2+Ftz^2)}$) is determined from the detection values of the force components in the three-axis directions (Ftx, Fty, and Ftz) indicated by the output of the floor reaction force sensor 13L (more specifically, the value obtained by removing a high-frequency component and a predetermined offset from the detection value of the force components in the three-axis directions). Then, the absolute value is multiplied by the sign of the detection value of the force component in the z-axis direction Ftz to determine the floor reaction force Ft_L. In other words, the floor reaction force Ft_L is calculated according to the following expression (2).

$$Ft_L=sgn(Ftz)\cdot\sqrt{Ftx^2+Fty^2+Ftz^2} \quad \text{Expression (2)}$$

where, in this case, if Ftz among the detection values of the force components in the three-axis directions (Ftx, Fty, and Ftz) lies within a predetermined minute range, then Ft_L is calculated with Ftz=0. Hence, Ft_L=0 in this case.

The magnitude of the floor reaction force Ft_L determined as described above is equal to the absolute value of the translational force vector detected by the floor reaction force sensor 13L and has the same sign as that of Ftz. In this case, regarding the sign of the floor reaction force Ft_L, if the left leg of the user A is a standing leg (if the foot-mounted assembly 3L is in contact with the ground), then Ft_L>0 always holds. Further, if the left leg of the user A is a free leg, then Ftz lies within the aforesaid predetermined minute range (the minute range has been defined as such), so that Ft_L=0. FIG. 4 shows, in terms of a vector, an example of Ft_L when Ft_L>0.

Subsequently, the processing by a target assisting force determiner 42L is carried out. This processing may be carried out before the processing by an assisting force measurement processor 43L and a bending angle measurement processor 45L.

The floor reaction force Ft_L is supplied from a floor reaction force measurement processor 41L to the target assisting force determiner 42L. An assisting ratio set value is input and stored and retained in the controller 6L in advance, and the assisting ratio is supplied also to the target assisting force determiner 42L. Here, the assisting ratio set value is the set value of a target proportion of the assisting force Fa_L relative to the floor reaction force Ft_L. Incidentally, the set value of the assisting ratio is commonly applied to the left and right leg links 4L and 4R. Alternatively, however, the assisting ratio may be separately set for each of the leg links 4L and 4R. When using the same set value of assisting ratio for both leg links 4L and 4R, the set value of assisting ratio is set to be slightly larger than, for example, the ratio of the weight of the walking assistance device 1 to the total sum of the weight of the user A and the weight of the walking assistance device 1. Furthermore, the assisting ratio may be variably set by key switch operation or the like.

Then, the target assisting force determiner 42L multiplies the input floor reaction force Ft_L by the assisting ratio set value to determine the target assisting force TFa_L. In other words, TFa_L is determined according to the following expression (3).

$$TFa_L=\text{Assisting ratio}\cdot Ft_L \quad (3)$$

FIG. 4 shows an example of the target assisting force TFa_L by a dashed-line arrow. The target assisting force TFa_L has a magnitude obtained by multiplying the absolute value of a floor reaction force vector acting on the foot-mounted assembly 3L by the assisting ratio, and it indicates the magnitude and the direction of a vector in the same direction as that of the assisting force Fa_L (the direction of the straight line connecting the third joint 19L and the first joint 17L). In the example in the figure, TFa_L>0.

Subsequently, the processing by a PID control unit 44L is carried out. Incidentally, this processing may be carried out before the processing by a bending angle measurement processor 45L.

The PID control unit 44L receives the assisting force Fa_L from the assisting force measurement processor 43L and the target assisting force TFa_L from the target assisting force determiner 42L. Then, the PID control unit 44L calculates a desired assisting force DFa_L according to a PID control law as a feedback control law from a difference between the input target assisting force TFa_L and assisting force Fa_L (=TFa_L−Fa_L). More specifically, the difference (TFa_L−Fa_L), a differential value thereof, and an integral value (cumulative addition value) are respectively multiplied by a predetermined gain and the results are added up so as to calculate the desired assisting force DFa_L. The desired assisting force DFa_L means an assisting force required to bring the assisting force Fa_L close to the target assisting force TFa_L (a supporting force to be applied to the leg link 4L from the foot-mounted assembly 3L). FIG. 4 shows an example of the desired assisting force DFa_L in terms of a vector.

Incidentally, the desired assisting force DFa_L agrees with the target assisting force TFa_L in a state wherein the assisting force Fa_L steadily agrees with the target assisting force TFa_L.

Subsequently, the processing by a torque converter 46L is carried out. The torque converter 46L receives a bending angle θ1_L of the leg link 4L from the bending angle measurement processor 45L and the desired assisting force DFa_L from the PID control unit 44L. In the controller 6L, a length D1 of the thigh frame 15 of each leg link 4 (the interval between the first joint 17 and the second joint 18 of each leg link 4. Refer to FIG. 4) and a length D2 of the crus frame 16 (the interval between the second joint 18 and the third joint 19 of each leg link 4. Refer to FIG. 4) are stored and retained beforehand in a memory, which is not shown. Then, these D1 and D2 are supplied to the torque converter 46L. Incidentally, D1 and D2 apply to both left and right leg links 4L and 4R.

Then, based on the input data, the torque converter 46L calculates a torque, which balances out a moment generated at the second joint 18L, on the basis of the desired assisting force DFa_L, as a torque command value DT_L for the electric motor 20L.

To be more specific, first, an interval D3 between the first joint 17L and the third joint 19L is calculated on the basis of the geometric relational expression (a geometric relational expression related to a triangle having the joints 17 to 19 in FIG. 4 as the apexes thereof) indicated by the following expression (4) from θ1_L, D1, and D2.

$$D3^2=D1^2+D2^2+2\cdot D1\cdot D2\cdot\cos\theta1_L \quad (4)$$

Subsequently, an angle θ2_L shown in FIG. 4 is calculated on the basis of the geometric relational expression (a geometric relational expression related to a triangle having the joints 17 to 19 in FIG. 4 as the apexes thereof) indicated by the following expression (5) from the D3 and the D1 and D2. The angle θ2_L is the angle formed by a segment connecting the first joint 17L and the third joint 19L (the segment of the length D3) and a segment connecting the second joint 18L and the third joint 19L (the segment of the length D2).

$$D1^2=D2^2+D3^2+2\cdot D2\cdot D3\cdot\cos\theta2_L \quad (5)$$

Subsequently, the torque command value DT_L is calculated according to the following expressions (6) and (7) from the angle θ2_L, the desired assisting force DFa_L, and the length D2 of the crus frame 16L.

$$F1_L=DFa_L\cdot\sin\theta2_L \quad (6)$$

$$DT_L=F1_L\cdot D2 \quad (7)$$

where F1_L denotes a component of the desired assisting force DFa_L, the component being in the direction orthogonal to a segment that connects the second joint 18L and the third joint 19L.

If the torque command value DT_L determined as described above takes a positive value, then it means a torque in the direction in which the leg link 4L stretches, and if it takes a negative value, then it means a torque in the direction in which the leg link 4L bends. FIG. 4 shows an example of the torque command value DT_L by the circular arrow. In this example, DT_L>0. Supplementally, the above expressions (4) to (7) indicate the correlations among the assisting force, the generated torque at the second joint 18L, and the bending angle θ1.

The torque command value DT_L determined by the torque converter 46L as described above is supplied to a driver circuit 31L as the command value that specifies the energizing current to the electric motor 20L. Then, the driver circuit 31L energizes the electric motor 20L according to the torque command value DT_L. This causes the electric motor 20L to generate a torque of the torque command value DT_L.

The above has explained the details of the control processing by the controller 6L. The same control processing is carried out by the controller 6R.

According to the present embodiment explained above, while the floor reaction force vector Ft acting on each foot-mounted assembly 3 is directly detected, the value obtained by multiplying the absolute value of the detected floor reaction force vector by the assisting ratio is defined as the target assisting force of each leg link 4. Then, the torque generated by each electric motor 20 is controlled so as to actually generate the target assisting force at the leg link 4. This makes it possible to generate an assisting force that matches the actual floor reaction force vector at each leg link 4 while reflecting the actual floor reaction force vector accompanying a motion of the user A. Furthermore, the assisting force allows a force in the lifting direction to act on the user A through the intermediary of the body-mounted assembly 2, thereby permitting effective reduction of a load borne by a leg (standing leg) of the user A himself/herself.

On the free leg of the user A, the target assisting force will be zero, so that an influence of a friction of the second joint 18 or the electric motor 20 will be compensated for, and the electric motor 20 will be controlled such that the friction will not be borne by a leg of the user A. Thus, a load on the free leg of the user A will be also reduced.

Further, the floor reaction force sensor 13 is provided at a location right below the MP joint of each foot of the user A, so that a floor reaction force vector on the toe side of the foot can be accurately detected from an output of the floor reaction force sensor 13. Hence, especially when the user A walks on a level ground or climbs stairs, a part of a floor reaction force required to kick a floor surface at the toes of the foot can be properly borne by each leg link 4.

Further, the floor reaction force sensor 13 is provided on the toe side of a foot of the user A, so that when the user A lands the foot-mounted assembly 3 of a free leg at the heel, it is possible to prevent an excessive floor reaction force vector due to the landing from directly acting on the floor reaction force sensor 13. As a result, a situation in which an assisting force instantly becomes excessive can be obviated.

A second embodiment of the present invention will now be explained with reference to FIG. 5 to FIG. 7. The present embodiment differs from the first embodiment only in a part of a mechanical construction and the control processing by a controller 6, so that the like components or the like functions as those of the first embodiment will use the like reference numerals as those in the first embodiment and the explanation thereof will be omitted.

FIG. 5 is a diagram showing a front view of a walking assistance device 51 according to the present embodiment and a user A wearing the same. As illustrated, the walking assistance device 51 according to the present embodiment is not provided with a supporting force sensor, and each leg link 4 is directly connected to an annular rigid member 8 of a foot-mounted assembly 3 through the intermediary of a third joint 19. In the walking assistance device 51, a torque sensor 52 for detecting a torque (a generated torque of an electric motor 20) imparted to a second joint 18 by the electric motor 20 is mounted, in place of a supporting force sensor, on the second joint 18. Hereinafter, a torque detected by the torque sensor 52 will be referred to as an assisting torque. The mechanical construction other than that explained above is the same as that of the first embodiment. The torque sensor 52 in combination with an assisting torque measurement processor, which will be discussed later, constitutes a torque detecting means in the present invention.

Further, in the present embodiment, as shown in the block diagram of FIG. 6, the controller 6 which controls each electric motor 20 includes a floor reaction force measurement processor 61, a torque converter 62, a target torque determiner 63, an assisting torque measurement processor 64, a bending angle measurement processor 65, and a PID control unit 66 as the functional means of an arithmetic processor 30 thereof. The construction of the controller 6 other than the above is the same as that of the first embodiment.

The detailed explanation of the processing of each section of the arithmetic processor 30 in the present embodiment will be given, and the control processing by each of the controllers 6 will be also explained with reference to FIG. 6 and FIG. 7. FIG. 7 is a diagram for explaining the control processing by the controllers 6. FIG. 7 schematically shows the leg link 4 and the foot-mounted assembly 3, as with FIG. 4. In the following explanation, the control processing by a controller 6L will be representatively explained, but the same applies to the controller 6R.

The controller 6L carries out the processing by an arithmetic processor 30L explained below at a predetermined control processing cycle. First, the outputs of the torque sensor 52L, the floor reaction force sensor 13L, and the rotary encoder 21L are captured into an assisting torque measurement processor 64L, a floor reaction force measurement processor 61L, and a bending angle measurement processor 65L, respectively, and the processing by these processors 64L, 61L, and 65L is carried out.

In the assisting torque measurement processor 64L, an assisting torque Ta_L is determined from the output of the torque sensor 52L (more specifically, the result obtained by removing a high-frequency component and a predetermined offset from the output). Here, in the present embodiment, the sign of the assisting torque Ta_L is set such that torques in the direction in which the leg link 4L stretches are positive, while torques in the direction in which the leg link bends are negative. At this time, in a state wherein the left leg of the user A is a standing leg, the assisting torque Ta_L detected by the torque sensor 52L is always Ta_L>0. In a state wherein the left leg of the user A is a free leg, if the user A tries to stretch the left leg, then Ta_L<0, or if the user A tries to bend the left leg, then Ta_L>0. FIG. 7 shows an example of the assisting torque Ta_L. In this case, Ta_L>0.

The floor reaction force measurement processor 61L determines the floor reaction force Ft_L (refer to FIG. 7) with a sign by the same processing as that by the floor reaction force measurement processor 41L in the aforesaid first embodiment.

Further, the bending angle measurement processor 65L determines the bending angle θ1_L shown in FIG. 7 by the same processing as that by the bending angle measurement processor 45L in the aforesaid first embodiment.

Subsequently, the processing by the torque converter 62L is carried out. Incidentally, this processing may be carried out before the processing by the assisting torque measurement processor 64L.

The torque converter 62L receives the bending angle θ1_L of the leg link 4L from the bending angle measurement processor 65L and also the floor reaction force Ft_L from the floor reaction force measurement processor 61L. The torque converter 62L also receives a length D1 of a thigh frame 15 and a length D2 of a crus frame 16 of each leg link 4, which have been stored and retained beforehand in the controller 6, as with the torque converter 46L in the aforesaid first embodiment.

Based on the input data, the torque converter 62L determines, as a floor reaction force equivalent torque Tt_L, a torque that balances out a moment generated at a second joint 18L due to a floor reaction force Ft_L (a translational force vector acting on the leg link 4L) in a case where it is assumed that the floor reaction force Ft_L acts on the leg link 4L from the foot-mounted assembly 3L through the intermediary of a third joint 19L (more specifically, in a case where it is assumed that the magnitude of the translational force vector actually acting on the leg link 4L from the foot-mounted assembly 3L is equal to the magnitude of the floor reaction force Ft_L and the direction of the translational force vector is the direction based on the sign of the floor reaction force Ft_L on a straight line connecting the first joint 17L and the third joint 19L).

To be more precise, first, based on θ1_L, D1, and D2, an angle θ2_L shown in FIG. 7, i.e., the angle θ2_L formed by a segment connecting the first joint 17L and the third joint 19L and a segment connecting the second joint 18L and the third joint 19L, is calculated according to the aforesaid expressions (4) and (5) explained in the first embodiment. Then, based on the angle θ2_L, the floor reaction force Ft_L, and the length D2 of the crus frame 16L, the floor reaction force equivalent torque Tt_L is calculated according to the following expressions (8) and (9) similar to the aforesaid expressions (6) and (7).

$$F2_L = Ft_L \cdot \sin \theta 2_L \tag{8}$$

$$Tt_L = F2_L \cdot D2 \tag{9}$$

where F2_L denotes a component of the floor reaction force Ft_L (indicated by the straight dashed-line arrow in FIG. 7) assumed to be acting on the leg link 4L, the component being in the direction orthogonal to the segment that connects the second joint 18L and the third joint 19L, as shown in FIG. 7. The relationship between the sign and the direction of the floor reaction force equivalent torque Tt_L determined as described above is the same as that of the assisting torque Ta_L.

Subsequently, the processing by a target torque determiner 63L is carried out. Incidentally, this processing may be carried out before the processing by the assisting torque measurement processor 64L.

The target torque determiner 63L receives the floor reaction force equivalent torque Tt_L from the torque converter 62L. The target torque determiner 63L also receives the set value of an assisting ratio that has been stored and retained beforehand in the controller 6L, as with the target assisting force determiner 42L in the first embodiment. Then, the target torque determiner 63L multiplies the input floor reaction force equivalent torque Tt_L by the set value of the assisting ratio to determine the target assisting torque TTa_L. In other words, TTa_L is determined according to the following expression (10).

$$TTa_L = \text{Assisting ratio} \cdot Tt_L \tag{10}$$

FIG. 7 shows an example of the target assisting torque TTa_L by the dashed-line arc arrow. In the illustrated example, TTa_L>0.

Supplementally, the target assisting torque TTa_L determined as described above is equivalent to the result obtained by converting the target assisting force TFa_L determined by the target assisting force determiner 42L into a torque at the second joint 18L by the same processing as that by the torque converter 62L (or the torque converter 46L) in the first embodiment. Alternatively, therefore, as with the first embodiment, after the target assisting force TFa_L is determined from the floor reaction force Ft_L, the determined target assisting force TFa_L may be converted into a torque by the same processing as that by the torque converter 62L (or the torque converter 46L) thereby to determine the target assisting torque TTa_L.

Subsequently, the processing by a PID control unit 66L is carried out. The PID control unit 66L receives the assisting torque Ta_L from the assisting torque measurement processor 64L and also the target assisting torque TTa_L from the target torque determiner 63L. Then, the PID control unit 66L calculates a torque command value DT_L for an electric motor 20L, which is for bringing the assisting torque Ta_L close to the target assisting torque TTa_L, according to the PID control law as a feedback control law from a difference between the input target assisting torque TTa_L and assisting torque Ta_L (=TTa_L−Ta_L). More specifically, the difference (TTa_L−Ta_L), a differential value thereof, and an integral value (cumulative addition value) are respectively multiplied by a predetermined gain and the results are added up thereby to calculate the torque command value DT_L. The relationship between the sign and the direction of the torque command value DT_L determined as described above is the same as that of the assisting torque Ta_L. FIG. 7 shows an example of the torque command value DT_L by an arc arrow. In this example, DT_L>0. The torque command value DT_L agrees with the target assisting torque TTa_L in a state wherein the assisting torque Ta_L steadily agrees with the target assisting torque TTa_L.

The torque command value DT_L determined by the PID control unit 66L as described above is supplied to a driver circuit 31L as a command value that specifies the energizing current to the electric motor 20L. At this time, as with the first embodiment, the electric motor 20L generates a torque of the torque command value DT_L.

The same control processing by the controller 6L explained above applies to the controller 6R.

The present embodiment does not directly control an assisting force as in the first embodiment; however, the target assisting torque TTa_L corresponds to the target assisting force TFa explained in the first embodiment. Hence, in the second embodiment also, as a result, an actual assisting force of each leg link 4 will be controlled to the target assisting force TFa, as with the first embodiment. Accordingly, the second embodiment permits the same advantages as those explained in the first embodiment.

A third embodiment according to the present invention will now be explained with reference to FIGS. 8(*a*) and (*b*). FIGS. 8(*a*) and (*b*) are diagrams of a front view and a side view, respectively, of a portion near the waist of a walking assistance device according to the present embodiment and a user wearing the same.

The present embodiment differs from the first or the second embodiment described above only in the construction of a body-mounted assembly. More specifically, in a walking assistance device 1 according to the present embodiment, a body-mounted assembly 70 is wound around the waist of a user A and roughly divided into a back member 71 wound onto the back and a front member 72 wound onto the front.

The back member 71 is a member extended from one side of the waist of the user A to the other side via the back, and it is formed of a hard material, such as a resin. Hinge members 73L and 73R are provided at the left and right side locations of the back member 71 (locations at the sides of the waist of the user A). Each of the hinge members 73 is provided with a fixed component 74 secured to the back member 71 and a movable component 76 connected to the fixed component 74 through the intermediary of a shaft pin 75 (refer to FIG. 8(*a*)), the movable component 76 being installed such that it can be swung with respect to the fixed component 74 (with respect to the back member 71) by using the shaft pin 75 as the supporting point thereof. In this case, as shown in FIG. 8(*b*), the axial center c of the shaft pin 75 is oriented substantially in the longitudinal direction. Hence, the movable component 76 can be swung about the axial center c in the longitudinal direction relative to the back member 71. Further, a leg link 4 having the same construction as that in the first embodiment is connected to the movable component 76 of each hinge member 73 through the intermediary of a first joint 17. More specifically, a leg link 4L is connected to the movable component 76 of a hinge member 73L through the intermediary of a first joint 17L, and a leg link 4R is connected to the movable component 76 of a hinge member 73R through the intermediary of a first joint 17R.

The above arrangement allows the leg links 4 to make swinging motions in the longitudinal direction by the first joints 17 and also to make abduction-adduction motions (swinging motions about the axial centers c of the shaft pins 75) by means of the hinge members 73.

Further, in the back member 71, the chassis 6*a* of each controller 6 explained in the aforesaid first embodiment is fixed at a location at the rear of each hinge member 73.

The front member 72 is a member that extends from one end of the back member 71 to the other end via the front of the waist of the user A, and it is constituted of a left belt 77L and a right belt 77R provided from the left end and the right end, respectively, of the back member 71, and a buckle 78 that connects these belts 77L and 77R at the front of the waist of the user A. Each belt 77 is formed of a flexible material. In this case, the circumferential length of the front member 72 (by extension, the total circumferential length of a body-mounted assembly 70) can be adjusted by the buckle 78, and the body-mounted assembly 70 is installed by being wound around the waist such that it is not vertically dislocated with respect to the waist of the user A (so as to allow a vertical force to act between the waist and the body-mounted assembly 70) by performing the aforesaid adjustment.

The construction of the walking assistance device 1 in the present embodiment other than that explained above is the same as the construction of the first embodiment or the second embodiment.

The present embodiment differs from the first embodiment or the second embodiment only in the construction of the body-mounted assembly 70, so that it is capable of providing the same advantages as those of the first embodiment or the second embodiment.

In the first to the third embodiments explained above, regarding the construction of the foot-mounted assembly 3, the annular rigid member 8, the rigid plate 9, the floor reaction force sensor 13, the hard elastic member 12, and the elastic ground contact portion 10 have been provided outside the shoe 7; these, however, may alternatively be accommodated in the shoe 7. At this time, the elastic ground contact portion 10 may be omitted, and the floor reaction force sensor 13 and the hard elastic member 12 may be interposed between the bottom surface of the interior of the shoe 7 and the rigid plate 9. In this case, the bottom portion of the shoe 7 functions as the elastic ground contact portion. If the annular rigid member 8 and the like are accommodated in the shoe 7, as described above, then the upper surface of the annular rigid member 8 is exposed through a shoelace attaching portion of the shoe 7 or positioned to face an opening formed in the shoelace attaching portion in order to connect each leg link 4 to the foot-mounted assembly 3, as previously described.

Further, in the first to the third embodiments, regarding the construction of the foot-mounted assembly 3, the rigid plate 9 has been provided. However, when assisting the user A in climbing stairs or a sloping road, a floor reaction force vector acting on the foot-mounted assembly 3 of a standing leg acts mainly on the toes of the foot-mounted assembly 3, so that the rigid plate 9 may be omitted. In this case, for example, the floor reaction force sensors 13 may be secured to the bottom surfaces of annular rigid members 8 and the hard elastic members 12 may be secured to the bottom surfaces of the heels of the shoes 7, and the elastic ground contact portions 10 may be secured to the lower surfaces of these floor reaction force sensors 13 and the hard elastic members 12.

INDUSTRIAL APPLICABILITY

As described above, the present invention is useful as a walking assistance device capable of causing an assisting force for assisting a user with his/her walking to properly act on the user.

Figure 1:
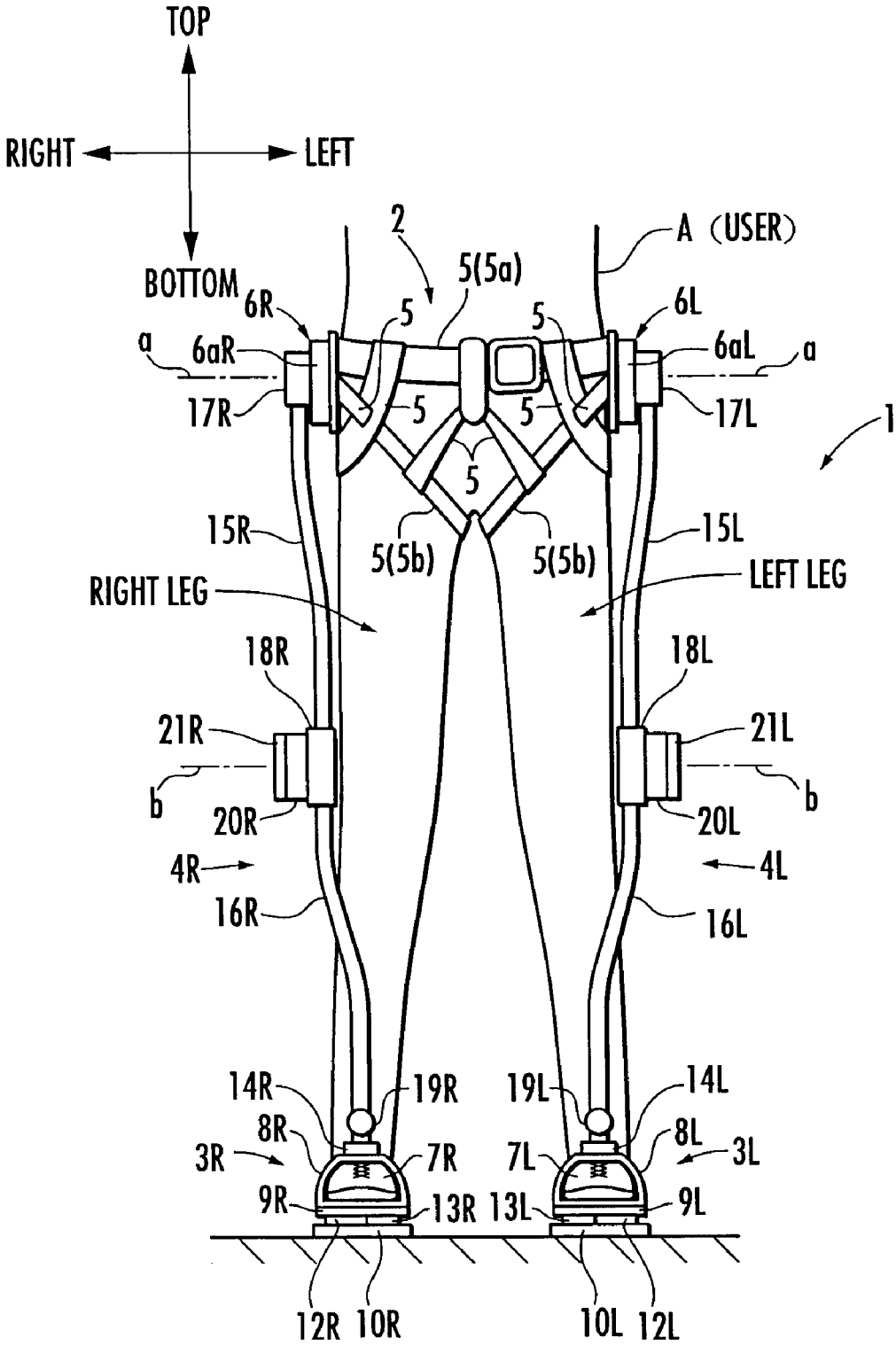
FIG. 1 is a diagram of a front view showing a walking assistance device according to a first embodiment of the present invention and a user wearing the same.
Figure 2:
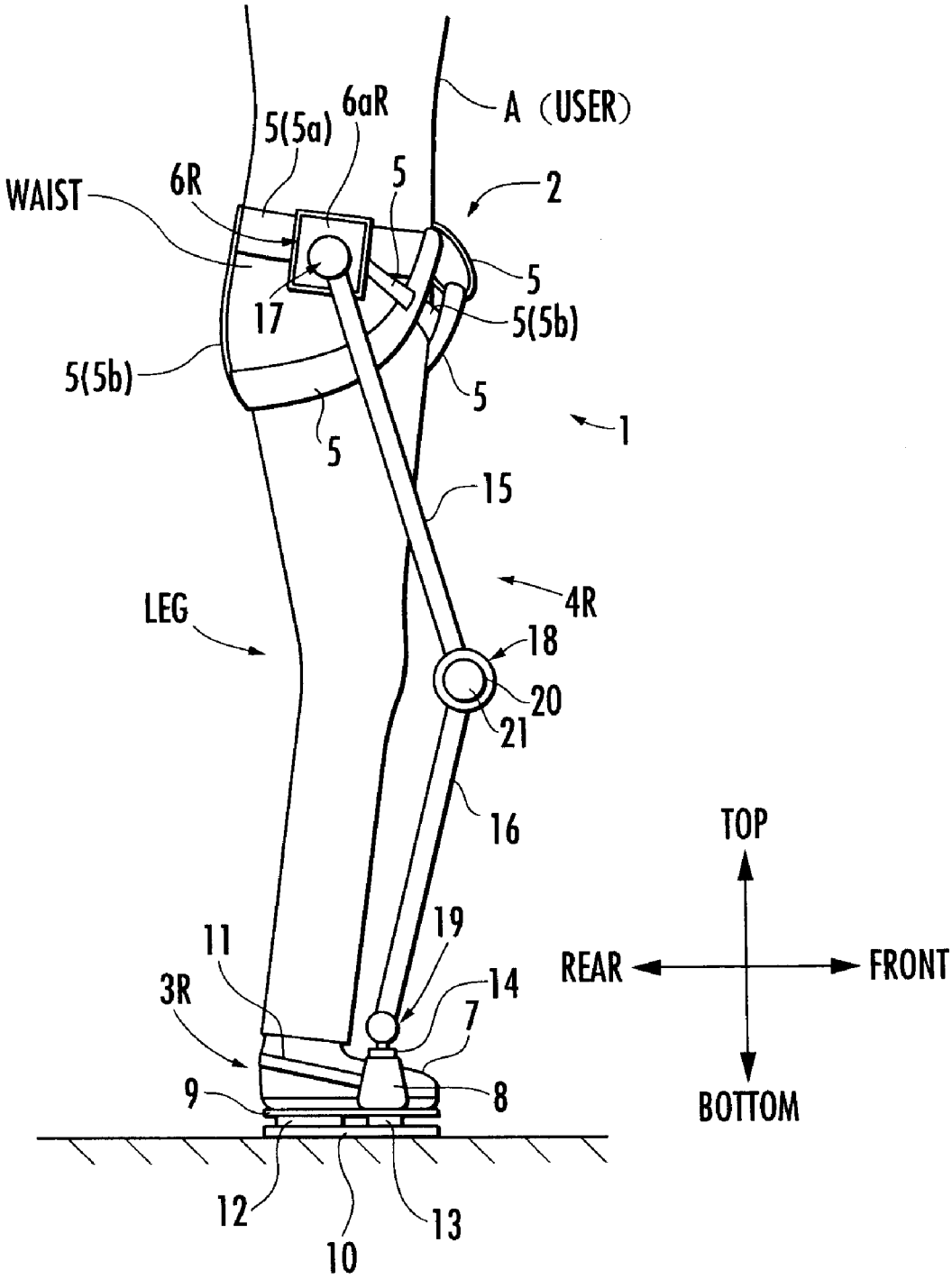
FIG. 2 is a diagram of a side view showing the walking assistance device according to the first embodiment and the user.
Figure 3:
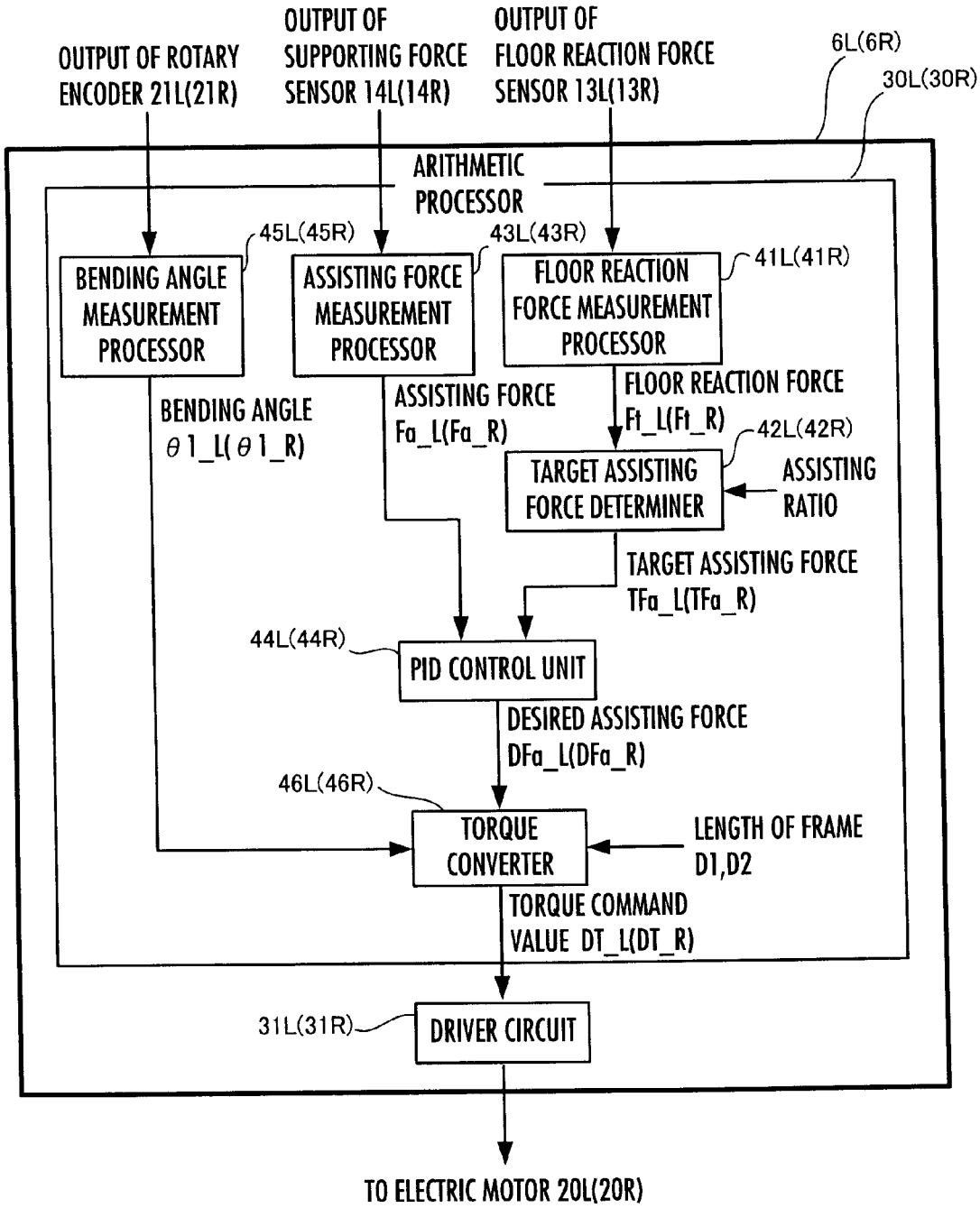
FIG. 3 is a block diagram showing a construction of a controller provided in the walking assistance device according to the first embodiment.
Figure 4:
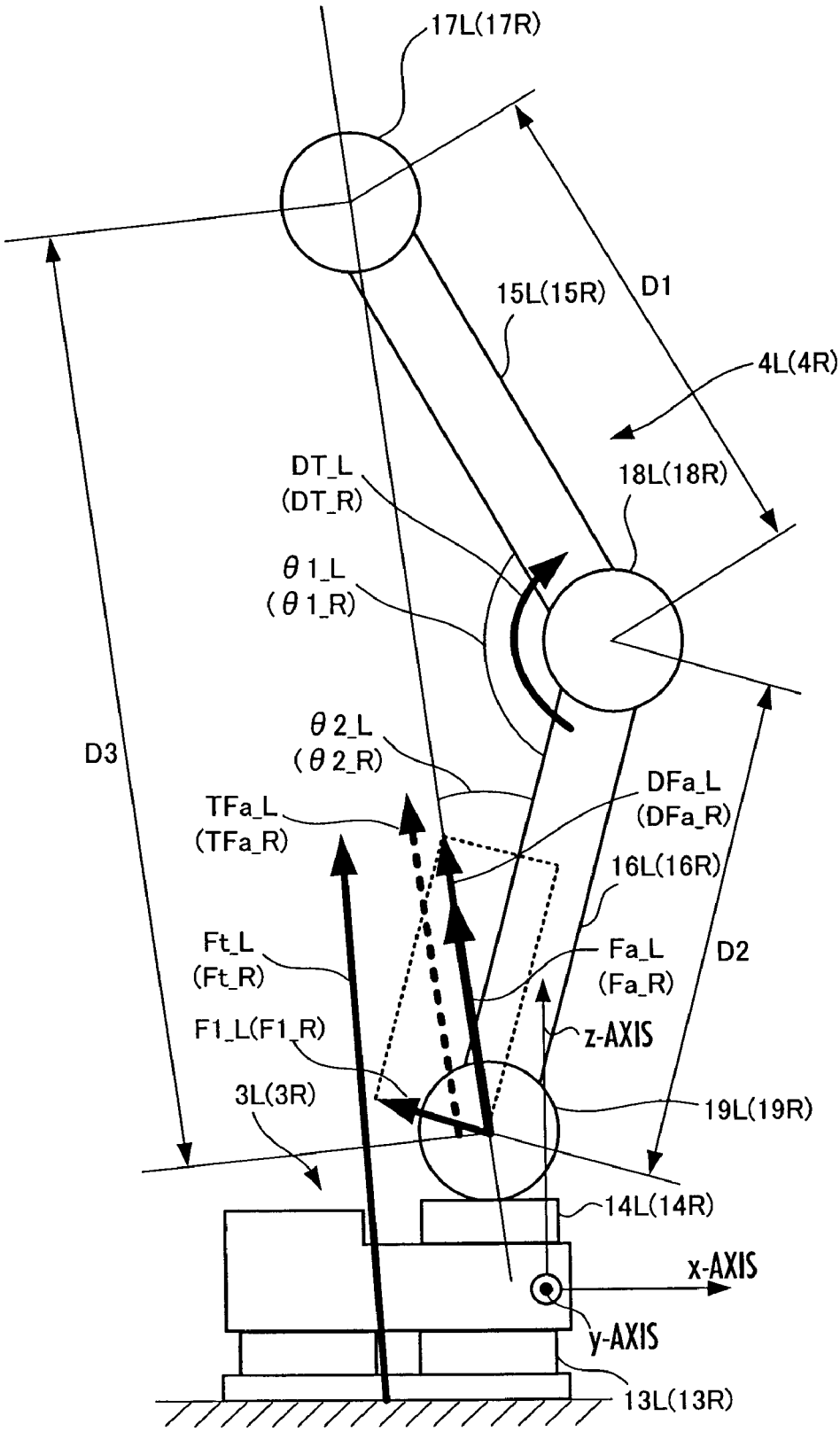
FIG. 4 is a diagram for explaining control processing by the controller in FIG. 3.
Figure 5:
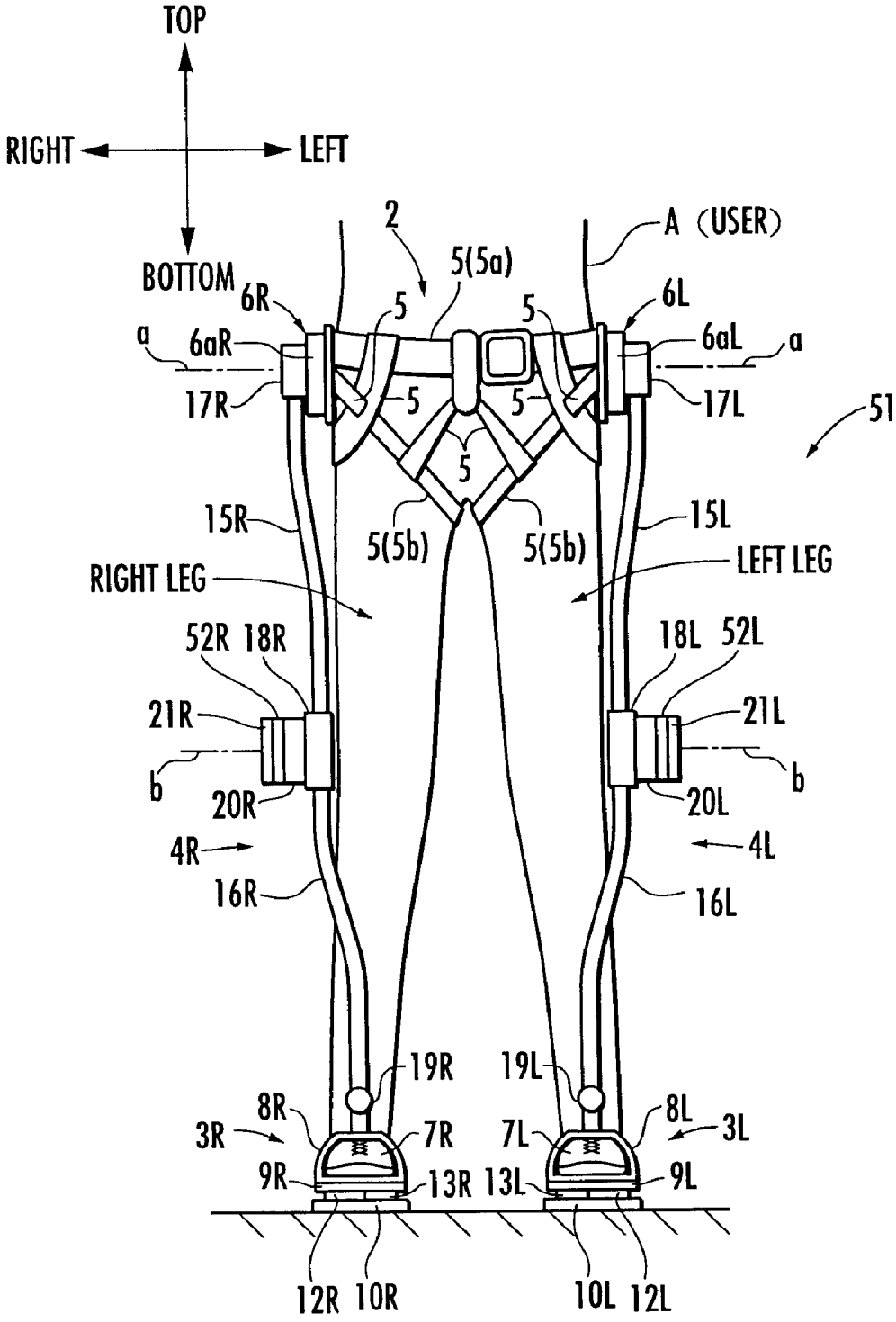
FIG. 5 is a diagram of a front view showing a walking assistance device according to a second embodiment of the present invention and a user wearing the same.
Figure 6:
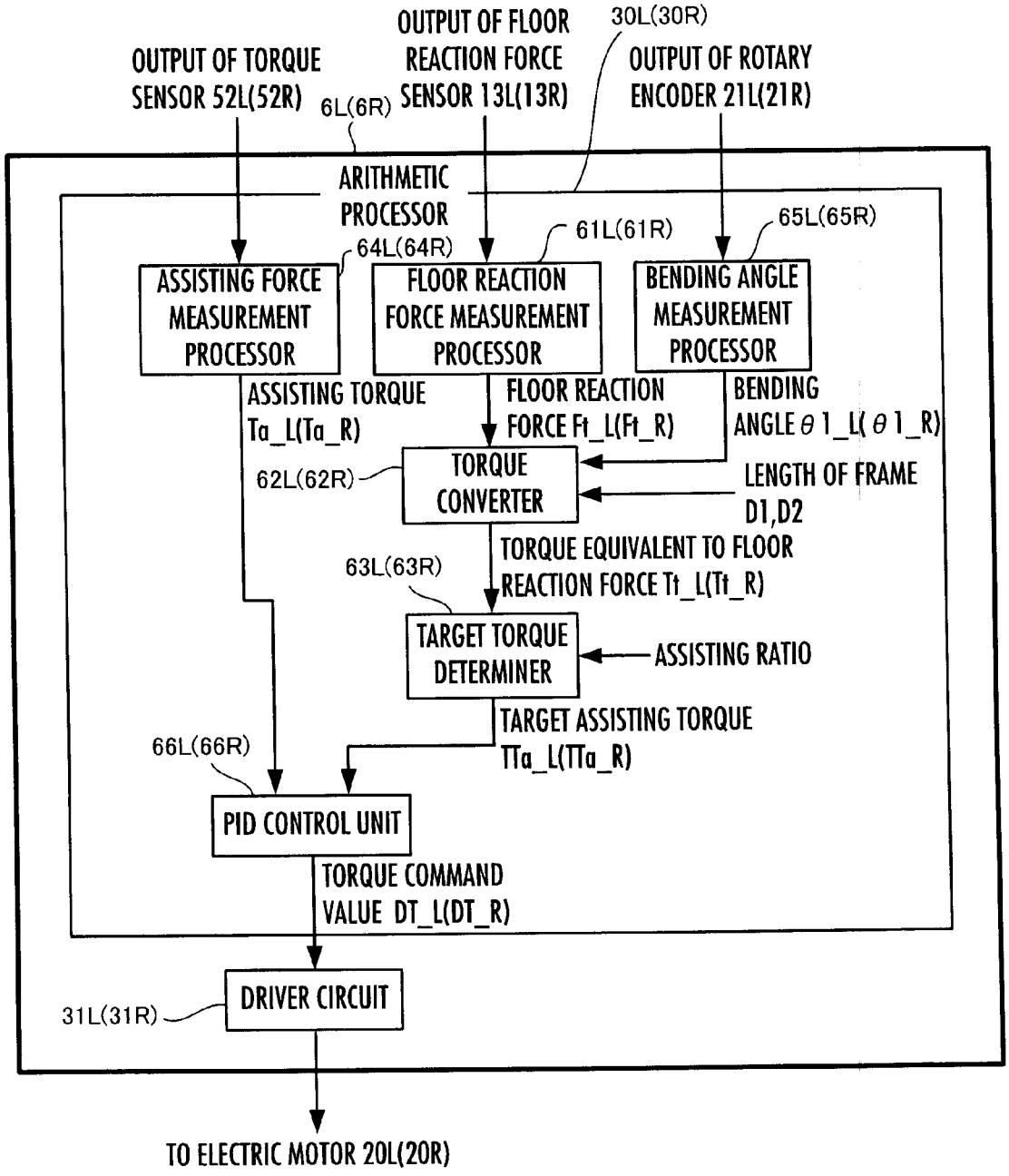
FIG. 6 is a block diagram showing a construction of a controller provided in the walking assistance device according to the second embodiment.
Figure 7:
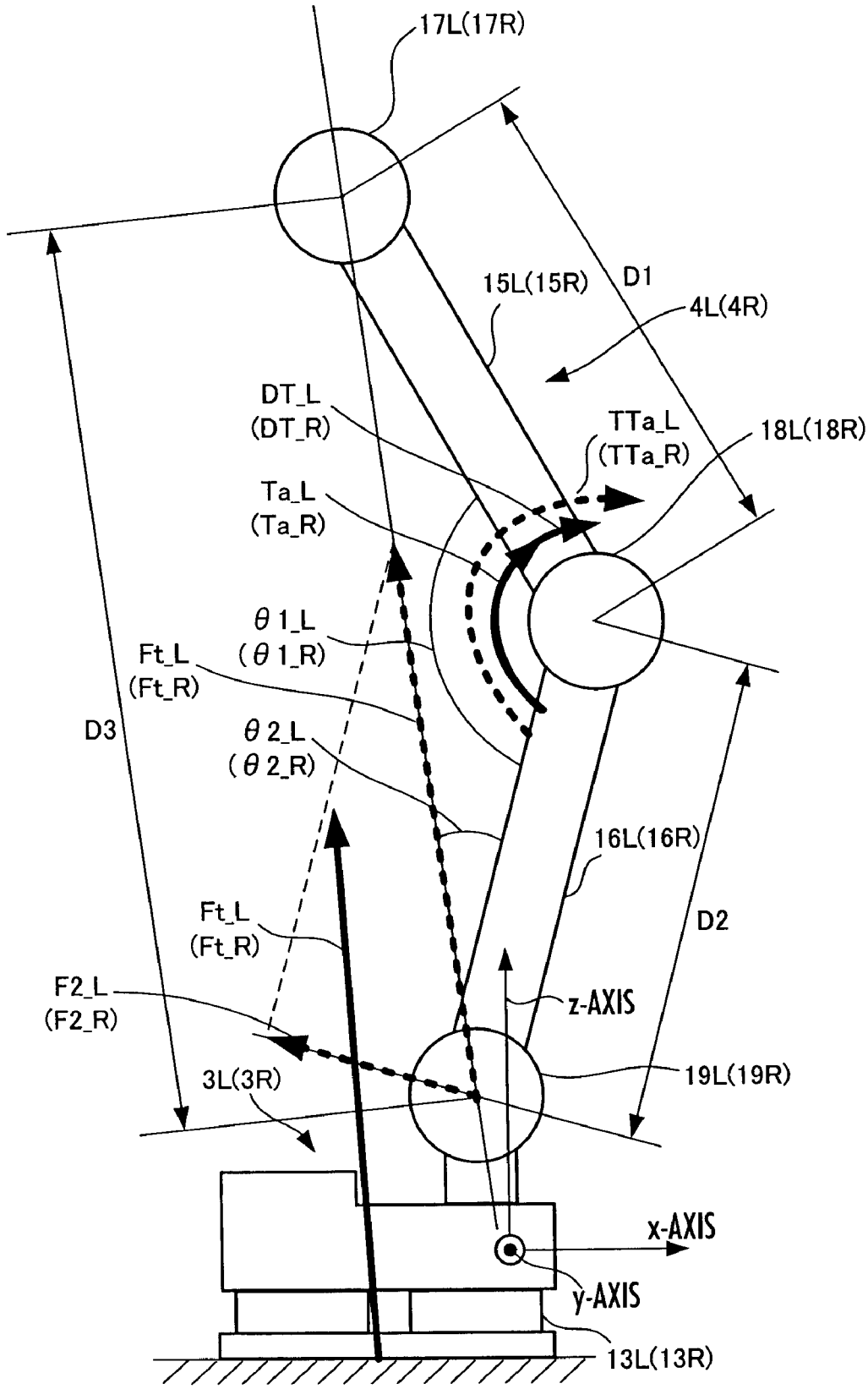
FIG. 7 is a diagram for explaining control processing by the controller in FIG. 6.
Figure 8:
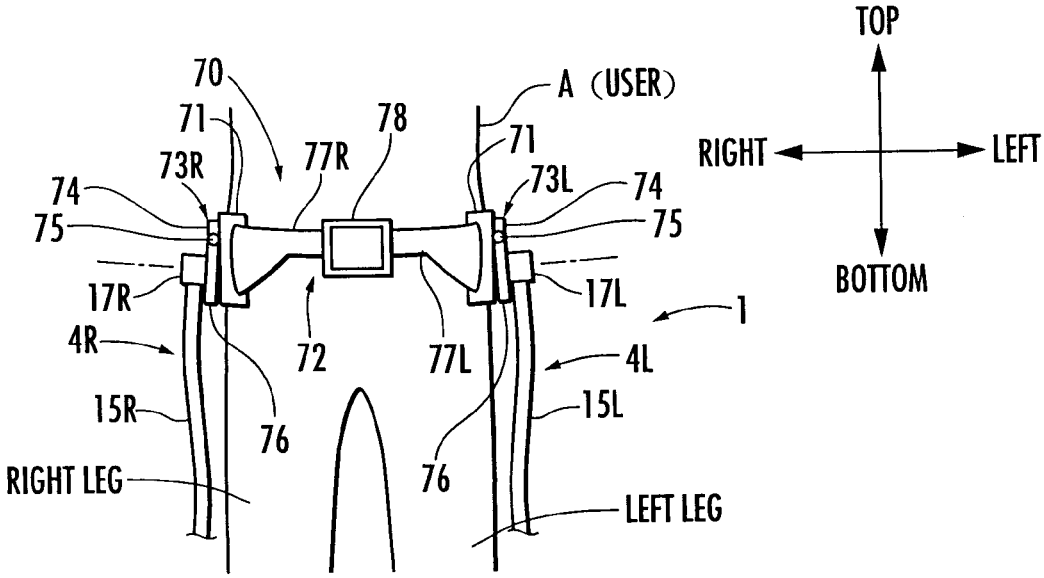
FIG. 8(*a*) is a diagram of a front view showing an essential section of a walking assistance device according to a third embodiment of the present invention and a user wearing the same, and FIG. 8(*b*) is a diagram of a side view showing an essential section of the walking assistance device and the user.
Figure 8:
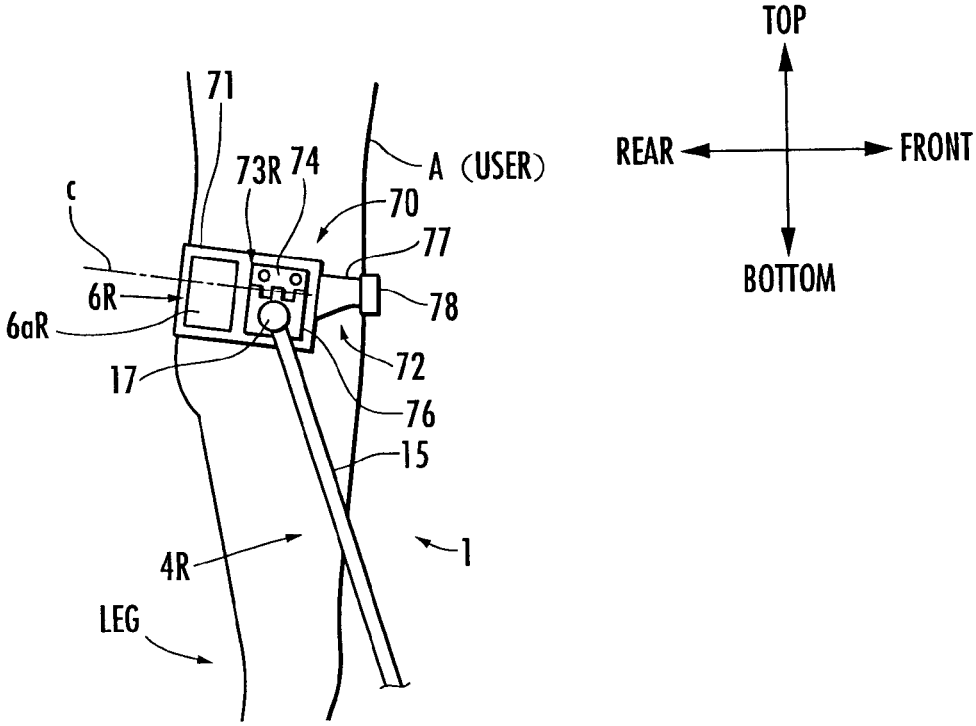

The invention claimed is:

1. A walking assistance device comprising: a body-mounted assembly adapted to be attached to a waist or torso or a thigh of a user; a pair of foot-mounted assemblies which are to be respectively attached to the feet of legs of the user; a pair of leg links which connects the foot-mounted assemblies and the body-mounted assembly, respectively; a first joint constituting a portion that connects each leg link and the body-mounted assembly; a second joint provided at a middle of each leg link, a third joint constituting a portion that connects each leg link and each foot-mounted assembly, and a pair of actuators that drives the second joints of the leg links, each of the foot-mounted assemblies including a ground contact portion adapted to come in contact with the ground such that a floor reaction force for supporting the user and the walking assistance device on a floor surface acts in a state wherein a leg of the user becomes a standing leg, the walking assistance device further comprising:

a floor reaction force detecting element configured to detect a floor reaction force acting on the ground contact portion of each foot-mounted assembly, the floor reaction force being detected as a three-dimensional floor reaction force vector; and an actuator control element configured to calculate a target value for a magnitude of a supporting force to be transmitted to each leg link in the floor reaction force vector and to control each of the actuators such that a supporting force having the magnitude of the target value is transmitted to the leg link from the foot-mounted assembly, wherein the actuator control element calculates the target value by an operation consisting of multiplying an absolute value of the detected floor reaction force vector of each foot-mounted assembly by a preset ratio, wherein the actuator control element is configured to set the target value for the magnitude of the supporting force to be transmitted to the leg link of a free leg of the user to zero.

2. The walking assistance device according to claim 1, wherein the second joint of each of the leg links is a joint that allows the leg link to bend and stretch, and each of the actuators is an actuator that imparts a torque to the second joint thereby to drive the second joint, and the actuator control element is configured to determine a torque command value of each actuator required to transmit the supporting force having the magnitude of the target value to each leg link from the foot-mounted assembly by using a correlation among the supporting force, a generated torque of the second joint, and a bending angle of the leg link at the second joint, which is determined by regarding the supporting force as a translational force vector having, as a line of action, a straight line that connects the first joint and the third joint of each leg link, and to control the actuator on the basis of the determined torque command value.

3. The walking assistance device according to claim 2, further comprising: a supporting force detecting element configured to detect the supporting force actually transmitted to each of the leg links from the foot-mounted assembly, and a bending angle detecting element configured to detect the bending angle of each of the leg links, wherein the actuator control element is configured to: calculate the target value for each leg link by multiplying the absolute value of the detected floor reaction force vector by the ratio; determine a required supporting force for each leg link by a feedback control law such that the magnitude of the detected supporting force is brought close to the calculated target value; determine a torque command value of each actuator on the basis of the determined required supporting force, the detected bending angle of each leg link, and the correlation; and control each actuator on the basis of the determined torque command value.

4. The walking assistance device according to claim 3, wherein the supporting force detecting element comprises a three-axis force sensor interposed between one of the third joint and the foot-mounted assembly, and the third joint and the leg link, and is configured to detect the supporting force on the basis of an output of the three-axis force sensor.

5. The walking assistance device according to claim 3, wherein the actuator control element is configured to set the target value associated with the leg link of a free leg of the user to zero.

6. The walking assistance device according to claim 2, further comprising a torque detecting element configured to detect a torque actually generated at the second joint of each of the leg links and a bending angle detecting element configured to detect the bending angle of each of the leg links, wherein the actuator control element is configured to: determine a target torque of the second joint of the leg link to transmit a supporting force having the magnitude of the target value to each leg link on the basis of the absolute value of the detected floor reaction force vector, the ratio, the detected bending angle of each leg link, and the correlation; determine the torque command value of each actuator by a feedback control law such that the detected torque of the second joint is brought close to the determined target torque; and control each actuator on the basis of the determined torque command value.

7. The walking assistance device according claim 6, wherein the actuator control element is configured to set the target torque associated with the leg link of a free leg of the user to zero.

8. The walking assistance device according to claim 1, wherein the floor reaction force detecting element comprises a three-axis force sensor provided in each foot-mounted assembly at the location right below the metatarsophalangeal joint of a foot of the user, and is configured to detect the floor reaction force vector on the basis of an output of the three-axis force sensor.

9. The walking assistance device according to claim 1, wherein each of the foot-mounted assemblies comprises an annular rigid member into which the toe portion of the foot of each leg of the user is inserted, the rigid member is connected to the leg link through the intermediary of the third joint, and the rigid member has the ground contact portion provided on the bottom surface thereof.

10. The walking assistance device according to claim 1, wherein a leg of the user is the free leg when the ground contact portion of the foot-mounted assembly attached to the feet of that leg is spaced from the ground.

11. The walking assistance device according to claim 1, wherein the floor reaction force detecting element detects the floor reaction force acting on the ground contact portion of the foot-mounted assembly attached to the free leg to be zero.

12. A walking assistance device comprising: a body-mounted assembly adapted to be attached to a waist or torso or a thigh of a user; a pair of foot-mounted assemblies which are to be respectively attached to the feet of legs of the user; a pair of leg links which connects the foot-mounted assemblies and the body-mounted assembly, respectively; a first joint constituting a portion that connects each leg link and the body-mounted assembly; a second joint provided at a middle of each leg link, a third joint constituting a portion that connects each leg link and each foot-mounted assembly, and a pair of actuators that drives the second joints of the leg links, each of the foot-mounted assemblies including a ground contact portion adapted to come in contact with the ground such that a floor reaction force for supporting the user and the walking assistance device on a floor surface acts in a state wherein a leg of the user becomes a standing leg, the walking assistance device further comprising:

a floor reaction force detecting element configured to detect a floor reaction force acting on the ground contact portion of each foot-mounted assembly, the floor reaction force being detected as a three-dimensional floor reaction force vector; and an actuator control element configured to calculate a target value for a magnitude of a supporting force to be transmitted to each leg link in the floor reaction force vector and to control each of the actuators such that a supporting force having the magnitude of the target value is transmitted to the leg link from the foot-mounted assembly, wherein the actuator control element calculates the target value by an operation consisting of multiplying an absolute value of the detected floor reaction force vector of each foot-mounted assembly by a preset ratio, wherein the preset ratio is a target proportion of the supporting force to be transmitted to each leg link relative to the floor reaction force.

13. The walking assistance device according to claim 12, wherein the actuator control element is configured to set the target value for the magnitude of the supporting force to be transmitted to the leg link of a free leg of the user to zero.

14. The walking assistance device according to claim 13, wherein a leg of the user is the free leg when the ground contact portion of the foot-mounted assembly attached to the feet of that leg is spaced from the ground.

15. The walking assistance device according to claim 13, wherein the floor reaction force detecting element detects the floor reaction force acting on the ground contact portion of the foot-mounted assembly attached to the free leg to be zero.

* * * * *